US006426003B2

(12) United States Patent
May et al.

(10) Patent No.: US 6,426,003 B2
(45) **Date of Patent: *Jul. 30, 2002**

(54) SCREENING DEVICE AND METHOD OF MANUFACTURE

(75) Inventors: Jonathan May, Sandy; Tim Wood, Melbourn; John Stephenson, Cherry Hinton, all of (GB); Jari Jurvanen, Varkaus (FI)

(73) Assignee: CAE Screenplates Oy, Varkaus (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/269,904

(22) PCT Filed: Oct. 3, 1996

(86) PCT No.: PCT/FI96/00520

§ 371 (c)(1),
(2), (4) Date: Aug. 19, 1999

(87) PCT Pub. No.: WO98/14658

PCT Pub. Date: Apr. 9, 1998

(51) Int. Cl.[7] ..... B01D 39/10

(52) U.S. Cl. ..... 210/498; 29/896.62; 29/897.15; 209/395

(58) Field of Search ..... 210/497.01, 498; 209/393, 395; 162/251; 29/896.62, 897.15; 428/595

(56) References Cited

U.S. PATENT DOCUMENTS

| | | | | |
|---|---|---|---|---|
| 2,963,781 | A | * 12/1960 | Smith | 428/595 |
| 3,716,144 | A | 2/1973 | Bartlow | |
| 3,805,955 | A | 4/1974 | Bixby et al. | |
| 3,864,264 | A | 2/1975 | Spohr et al. | |
| 3,901,801 | A | 8/1975 | Bixby | |
| 3,923,649 | A | 12/1975 | Sparham et al. | |
| 4,002,540 | A | 1/1977 | Bixby | |
| 4,184,950 | A | 1/1980 | Bixby | |
| 4,846,971 | A | 7/1989 | Lamort | |
| 5,011,065 | A | 4/1991 | Musselmann | |
| 5,090,721 | A | 2/1992 | Lange | |
| 5,094,360 | A | 3/1992 | Lange | |

FOREIGN PATENT DOCUMENTS

| | | |
|---|---|---|
| DE | 42 24 727 | 2/1994 |

* cited by examiner

*Primary Examiner*—Matthew O. Savage
(74) *Attorney, Agent, or Firm*—Nixon & Vanderhye P.C.

(57) ABSTRACT

A screening device (e.g. screen plate or screen cylinder) is manufactured relatively inexpensively and easily yet has uniform screening openings (e.g. screening slots) even when of a width of less than 0.5 mm. A plurality of wires having first and second sections (the second sections having base portions and of smaller cross-section than the first sections) are mounted substantially parallel to each other, supported by at least one support bar or ring. The bars or rings have slots formed in a first side surface, and a cavity in open communication with the slots in a second side surface. The wires are fixed to the bars or rings by deforming the wires (e.g. by bending a flap, engagement by a reciprocating tool, welding, etc.) within the cavity, or by deformation of the support bar or ring in the cavity. The screen plate or cylinder is preferably used to screen or otherwise treat a cellulose pulp suspension, e.g. by subjecting the first sections of the wires to a flow of pulp with accepts passing through the screening openings.

8 Claims, 4 Drawing Sheets

SCREENING DEVICE AND METHOD OF MANUFACTURE

CROSS-REFERENCE TO RELATED APPLICATION

This application is a U.S. national phase of PCT/F196/00520 filed Oct. 3, 1996.

BACKGROUND AND SUMMARY OF THE INVENTION

The present invention refers to a screening device and a method of manufacture thereof that are particularly suitable for screen cylinders or screen plates which screen, filter, fractionate, or sort cellulose pulp suspensions (that is in the pulp and paper making industry), or other similar suspensions. The present invention thereby refers to screening devices, such as screen cylinders or bended or flat screening elements, for screening, filtrating, fractioning or sorting pulp suspensions in pulp and paper making industry or other similar suspensions. The present invention more particularly refers to screening devices of the type comprising a plurality of filter wires positioned at a small spacing parallel to each other, the plurality of filter wires forming a screening surface facing the pulp suspension to be screened and adjacent wires forming screening openings therebetween allowing an accept portion of the pulp suspension to flow therethrough. EP 0 316 570 suggests such a screening device in which the filter wires are fixed by welding, on the downstream side of the wires, to transversely extending slots in solid support elements, support rings or support bars. The screening devices may have various forms, e.g. be flat, bended, cylindrical or conical.

In known screening devices of this type the support elements, which form supports for the filter wires, are formed of solid bars, mainly rectangular or round in cross section and most typically positioned perpendicular to the filter wires.

The filter wires are generally fastened to the supporting bars by a welding process which gives rise to a number of disadvantages such as variability distortion, thermal stresses and burrs. The heat induced by the welding often cause distortion of the wires and changes in the screening opening width between adjacent wires. It is therefore difficult to get completely uniform screening openings, which means that the efficiency of the screen suffers. Today, when the desired width of screening openings may be as small as 0.1 mm, only minimal distortions are acceptable.

The thermal stresses and the burrs may also lead to failure in operation due to the loading on the screening device in the user's process. Such loading may be either in the form of a constant load or a cyclic loading giving rise to failure by fatigue. Burrs may also catch fibers in the suspension, leading to gradual clogging of the screen or filter, or the formation of so called "strings" which are very detrimental in the user's process.

It has also been suggested, e.g. in U.S. Pat. Nos. 5,090,721 and 5,094,360, to connect filter wires of a certain "key" cross section into recesses, in the support bar, having the same "key" form. By means of bending the supporting bars into rings, the filter wires are clamped into position. This design, thereby, requires the manufacturing of a number of relatively complicated and therefore expensive recesses. Further, it can only be adapted to circular screens and screens, where the flow is from the inside to the outside of the circular screen.

In another known screening device the filter wires are fastened by looping them around support bars. Such a screen construction is strong, but the looping areas around the support bars is locally closing the openings and thereby reducing throughput of the screen. Also the looped areas tend to have cavities and uneven spots which are facing the suspension potentially causing fiber hang-up.

The above difficulties tend to result in poor quality of screening or mechanical weaknesses or to high manufacturing costs, it is therefore the object of the present invention to minimize the above mentioned drawbacks and provide an improved screening device and an improved method of manufacturing such device.

It is thereby also an object of the present invention to provide an easily manufactured and assembled screening device without thermally induced distortion of filter wires.

It is also an object of the present invention to provide an improved strong screening device with accurate and consistent screening openings, i.e. screening slots.

It is thereby further an object of the present invention to provide an improved method of manufacturing a screening device, so that uniform screening openings, i.e. good tolerances, are provided, whereby slots with very small widths may be manufactured.

It is further an object of the present invention to provide an improved screening device with minimum of burrs or other protruding elements causing accumulation of fibers on upstream side surfaces of support rods.

According to one aspect of the present invention a screening device is provided comprising the following components: A plurality of filter wires each comprising a first section and a second section opposite the first section, the second section having a base portion. At least one longitudinal one longitudinal support element having first and second side surfaces, a plurality of slots in the first side surface, and a cavity in the second side surface in open communication with the slots. And, the second sections received by the slots so that the base portions extend through the slots into the cavity, and the wires are supported by the at least one support element so that the wires are substantially parallel to each other and define screening openings therebetween adjacent the first sections thereof.

The wires are preferably fixed to the support element(s) by local deformation of the base portions in the cavities, such as by effecting an increased material thickness portion of the base portion formed by reciprocation of a tool, by bending over a flap of the base portion, or by forming a weld between the base portion and the supporting element substantially within the cavity. Typically the second sections and base portions have a smaller cross-sectional area than the first sections. Alternatively the support element could be deformed within the cavity.

Typically the wires define screening slots having a slot width of less than 0.5 mm. The at least one support element may typically comprise a bar or a support ring; for example the at least one support element comprises a plurality of support rings, and the wires define a screen cylinder as the screening device. In the preferred embodiment the slots and wires are substantially transverse to the support rings, and the screen cylinder is positioned in a pressure screen so that the first sections of the wires and the first surfaces of the support rings impact slurry flowing through the screening slots.

The support element may be substantially U, L, or V-shaped in cross-section. Preferably the support element has a total height H, and the slots have a depth h2, wherein h2 equals (0.25–0.5) H; and the filter wires have a height h, and h2 equals (0.3–0.9) h.

According to another aspect of the present invention a method of manufacturing a screening device is provided comprising: (a) Providing a plurality of filter wires each having opposite first and second sections, and a base portion at the second section; and at least one longitudinal support element having first and second side surfaces, a plurality of slots in the first side surface, and a cavity in the second side surface in open communication with the slots. (b) Inserting the wires in the slots so that the base portions thereof extend into the cavity and the wires are substantially parallel to each other and define screening openings between the first sections thereof. And, (c) fixing the wires to the at least one support element substantially within the cavities.

Thereby a preferred screening device according to the present invention, comprising a plurality of filter wires supported by at least one longitudinal support element is provided, in which a plurality of supporting slots or recesses are made through the upstream side surface of the support element and the filter wires are fixed to the slots. The longitudinal direction of the supporting slots or recesses thereby form an angle, typically an angle of 90°, with the longitudinal axis of the support element and have a form adapted to receive the downstream section of the filter wires. The slots are typically cut perpendicularly into the support element, i.e. radially to the longitudinal axis of the support element, but may be cut at an angle between 10° to 90° into the support element, if the wires are to be supported in an inclined position. The filter wires are fixed to the slots or recesses by local deformation of the material in the downstream section of the filter wires or in the slot or recess limiting area of the support elements, after assembly of wires into the supporting slots in the support elements.

In a screening device, according to a preferred embodiment of the present invention, the at least one support element has on its upstream side supporting slots and on its downstream side a cavity delimited by side surfaces. The cavity may be formed by a variety of techniques including drawing, extrusion, rolling or machining. The plurality of supporting slots are preferably through openings reaching from the upstream side surface of the support element to the cavity. During assembly of the downstream section of a filter wire is inserted into the supporting slot in the support element the base portion thereof protruding through the slot into the cavity and preferably intersecting the cavity. The upstream side surface of the support element facing the suspension flow preferably has a rounded (convex) shape in order to reduce the flow resistance.

The slots, which may be formed e.g. by machining, stamping, spark erosion or laser, form an angle that intersects the axis of the support element. This angle is typically 90° but could be within the range of 1° to 90°. The spacing and the depth of supporting slots determine the position of the filter wires inserted therein and thereby also the width of the screening opening.

The filter wires are fixed to the support element by deforming the base portion of the downstream section of the wires, so that the deformation prevents the base portion from re-entering the slot and the wire from being pulled out. Filter wire material encapsulated within the support element cavity is preferably deformed by using mechanical force. The deformed material forms a mechanical joint, which has no burrs, but has good properties of fatigue resistance. The shape of the deformed material determines the ultimate performance of the joint in resisting forces generated by the filtration process. The form of the joint also determines the ultimate fatigue resistance of the jointed materials.

The shape of deformation may be determined by the tooling used to form the joints. The tool may e.g. have a flat, concave, convex, conical or domed form to cause material to flow in a direction determined to be optimal for the joint in question. Joints may be completed singly or in multiples in parallel filter wires to speed screening device production or ensure stability during processing. Other tooling may simultaneously be used to support adjacent supporting slots in the support elements to allow maximum force to be applied to the joints being formed, thus ensuring no distortion of adjacent support slots or filter wires occur. The support may be provided by the inserted filter wires being held in position by a clamping force.

Transverse slots in adjacent, preferably parallel, support elements should be in alignment to accept straight filter wire lengths. Filter wire material usually has to be straightened before assembly and connection to supporting slots.

According to another embodiment of the present invention, the filter wire is inserted into a supporting slot or recess, whereafter the support element material in the slot or recess area is locally (point wise or sectionally) deformed to press portions of the slot walls against the filter wire portion within the slot or recess. The deformation of the slot or recess is made at chosen locations to prevent the filter wire from being pulled out of the slot or recess. The slot or recess is preferably deformed by a mechanical force, such as pressing or stamping, directed onto the upstream side surface of the support element. The mechanical force is located so as to provide local deformation of the support element material around the slot or recess, without causing deformation or distortion of the whole support element and without causing distortion of the filter wire. The downstream section of the filter wire, inserted in the slot or recess, may be shaped in the slot or recess region to provide a space for deformed material and provide a re-entrant feature, so as to strengthen the joint. The deformation of the side surfaces is then adapted to lock the shaped wire in the slot or recess. If the slot is made as a through opening then both the base portion of the wire and the slot wall material may be deformed to provide a joint.

The support element and the filter wire are preferably supported during the mechanical deforming process to prevent undesired changes in the assembly.

The new method of manufacturing a screening device, according to a preferred embodiment of the present invention includes

- forming in the upstream side surface of the at least one support element, by machining, cutting or another similar way, a plurality of supporting slots, which form an angle with the axis of the support element and are adapted to receive the downstream section of said filter wires,
- inserting a filter wire of the plurality of filter wires in a supporting slot of the plurality of supporting slots, and
- fixing the filter wire inserted in a supporting slot to the support element by locally deforming the material in the downstream section of the filter wire or in the slot limiting area of the support element.

In a screen cylinder according to the invention the support element is preferably a circular ring having a plurality of filter wires, parallel to the axis of the cylinder, fastened thereon. The filter wires may be fastened to the inner or outer periphery of the ring. Preferably there are at least two rings in each screen cylinder, but maybe more. The rings may simultaneously form supporting rings stabilizing the screen cylinder itself.

Preferably the plurality of supporting slots, made on the support element by machining or in any other suitable way, are mainly perpendicular to the longitudinal axis of the at least one support element, so that filter wires connected to the support element are perpendicular to said elements. It is, however, possible to provide inclined supporting slots on the support elements if desired, for inclined support.

The cross section of the filter wires preferably has a wider section facing the suspension to be screened and a narrower section protruding into the slots in the support element (support bar), for creating a relief channel between adjacent filter wires for the suspension to pass through. The width of the section facing the suspension is typically 2 to 8 mm, preferably 2,8 to 5 mm.

The support elements according to the invention may be made of a bar having a U- L- or V-shaped or other similarly shaped cross section. The bar thereby has a bent or an angled first, e.g. middle, portion onto which the filter wires are fastened and a second portion forming an additional support body. The convex or external side surface of the bent or angled first portion of the bar forms the upstream side surface facing the flow of suspension flowing through the screening device.

Typically a support element according to a preferred embodiment of the present invention is made of a partly solid support bar, the cross section of which is preferably slightly elongated, one end of the cross section being rounded or convex and the opposite end having a cavity formed therein. The support bar is disposed in the screening device, so that the rounded or convex side is arranged to face the flow coming through the screening openings formed between adjacent wires, for providing an optimal flow along the external surface of the support bar. The cavity in the support bar is thereby provided on the downstream side of the support element. The total height of the support bar is typically in the range of 10 to 25 mm, preferably 13 to 20 mm, and the width thereof in the range of 5 to 15 mm, preferably about 6 to 8 mm. The cavity protrudes typically about 5 to 15 mm, preferably 6 to 10 mm, into the downstream side of the support bar. The wall thickness of the support bar on the sides of the cavity may be 1 mm or more, typically about 1–3 mm.

Supporting slots are made into the convex or rounded upstream side of the support bar. The supporting slots typically have a depth $h_2$ corresponding to 0.25 to 0.50 of the total height H of the support element. The supporting slots thereby may have a depth $h_2$ 0.3 to 0.9 of the height of the filter wires. The slots reach typically 1 to 3 mm deep into the cavity.

Wires having a height of about 5 to 15 mm, preferably about 7 to 12 mm, are supported by the support bars. The cross section of the wires has a funnel shaped wide upper (i.e. upstream) section, having a width decreasing in the downstream direction from preferably about 3 to 5 mm to about 1.5 to 3 mm in the upper ⅓ to ½ portion of the total height of the wire. The wire is inserted into the supporting slot, which preferably has a funnel shaped upper section corresponding to the form of the wire. The depth of the support slot and/or the funnel shaped upper ends of the slot and the wire determine the depth to which the wire may be inserted into the slot.

A base portion of the downstream end of the wire reaches according to a preferred embodiment of the present invention the cavity within the support bar. The wire is fixed to the support bar by providing a deformation to at least a portion of the wire portion reaching into the cavity, so that this deformation prevents the wire from being pulled out of the slot. The deformation may preferably be brought about by mechanically deforming, e.g. by stamping or swaging, at least a portion of the wire within the cavity. A deformation, according to the present invention, may alternatively be brought about by welding, soldering, gluing or in another similar non-releasable way, in which a fastening material is fixed to the downstream end of the wire, for attaching said wire to the inner walls of the cavity.

The support element may, according to another embodiment of the present invention, be made of a U-bar, having a material thickness of about 1–5 mm, preferably 1.5–2 mm. The middle portion of the U-bar has a bend with a radius of e.g. about 3–6 mm. A plurality of parallel supporting slots is made across the first middle portion of the bar, the supporting slots having a depth corresponding to ¼ to ½, advantageously ⅓ of the total height H of the U-bar. Preferably the supporting slots have a depth corresponding to ⅓ to ⅔ of the height h of a filter wire, whereby ⅔ to ⅓ of a filter wire inserted in a slot will still protrude above the supporting bar. The supporting slots may have a depth of 3–7 mm, e.g. 3,5 mm and the width of the upper portion of a supporting slot (in the longitudinal direction of the U-bar) may be about 1–3 mm, e.g. 1,5 mm.

The filter wire may, according to another embodiment of the present invention, be fastened to a supporting slot in a support bar, e.g. a U-bar or a partly solid bar having a cavity machined therein, by bending at least a portion of the downstream edge or base portion of the filter wire, protruding into the cavity of the support bar. Two preferably parallel notches may be provided perpendicular to the wire in the downstream edge of the wire, for providing an easily deformed or bendable flap. The notches are made long enough to enable the flap to be deformed or bent for locking the filter wire in the supporting slot and thereby fastening the wire to the bar.

The present invention is applicable in screen cylinders having inward or outward flow of suspension to be screened. In inward flow screens filter wires are connected to the external surface of supporting rings and in outward flow to the inner surface of the rings respectively.

The present invention provides a substantially improved screening device and method of manufacturing and assembling such device. The invention particularly provides an improved method of manufacturing a screening device, so that accurate and uniform screening slots, i.e. good tolerance, with very small widths may be manufactured. The new screening device provides a method of manufacturing a strong screening device with a minimum of burrs or other protruding elements causing accumulation of fibers.

The invention will be discussed in more detail in accordance with enclosed drawings in which

DETAILED DESCRIPTION OF THE DRAWINGS

Figure 1:
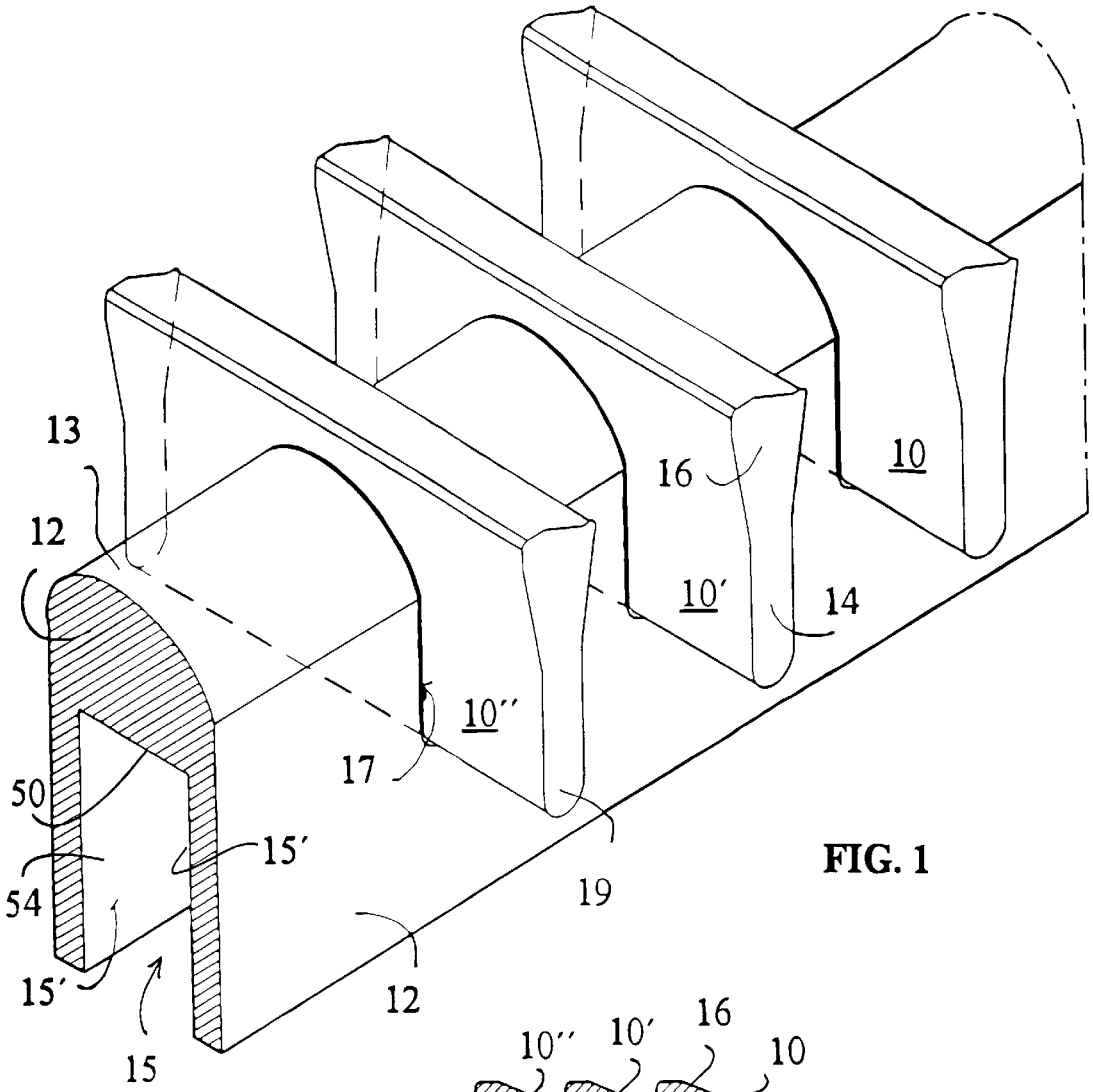
FIG. 1 shows schematically a top side view of filter wires positioned onto a support element according to a preferred embodiment of the present invention.

FIG. 1 shows schematically a top/side view of a portion of a screening device according to a preferred embodiment of the present invention. In FIG. 1 three filter wires 10, 10' and 10" are positioned onto a partly solid support bar 12, having an elongated cross section with a rounded top part 13, facing accept flow, and a bottom part with a cavity 15, having side walls 15', therein.

The filter wires 10, 10', 10" have narrow lower parts 14, i.e. down-stream portions, and funnel shaped upward widening top parts 16, i.e. upstream portions. The wires are mounted onto the support bar by inserting the narrow lower parts 14 in slots 17 formed through the top or upstream side of the support bar 12. The slots 17 are substantially perpendicular to the longitudinal axis of the support bar 12. The slots 17 are also substantially perpendicular to the top surface of the support bar, for the filter wires to reach radially outward from the support bar.

Figure 2:
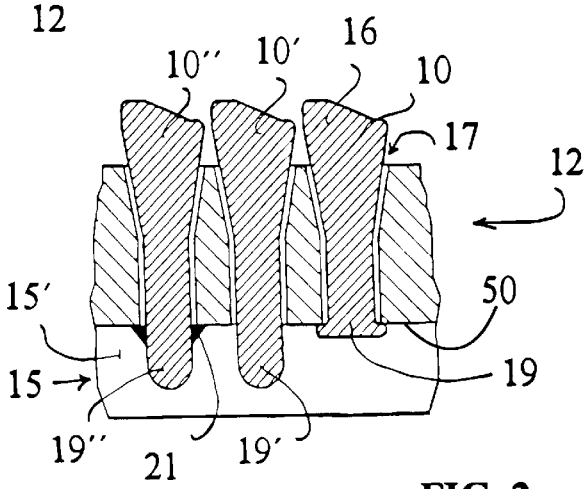
FIG. 2 shows a longitudinal cross section of a portion of the support element in FIG. 1 with three filter wires supported thereon.

The bottom edges 19of the filter wires 10 - 10' reach into the cavity 15 in the bottom part of the support bar as can be better seen in FIG. 2. FIG. 2 also shows that the funnel shaped top parts of the wires 10, 10' and 10" are adapted to fit into similarly formed funnel shaped upper parts of the slots 17.

In FIG. 2 wire 10' represents a wire positioned in a slot 17, but not yet fixed thereto. Filter wires 10 and 10" have been fastened to the support bar 12 according to different embodiments of the present invention, for exemplary purposes only. Wire 10 has been fixed to the slot 17 by mechanical deformation of the bottom wire edge 19". The edge 19' has been deformed, so that the width of the edge exceeds the width of the slot 17, thereby preventing the wire from being pulled out through the slot.

Wire 10" is fastened by welding. A slight deformation of the edge 19 of the wire 10" takes place when welding the wire to the side wall 15', by welds 21 forming on the edge. The welds prevent the base portion or edge of the wire from being pulled out of the slot. Different types of welding may be used such as laser, TIG, or plasma welding. Only relatively small amount of heat is needed for welding a thin wire edge to a support bar, the wire edge having a rather small material thickness. Therefore distortions can be prevented in the method according to the present invention. Further advantage is achieved by the welding being, according to the present invention, performed on the cavity side of a support bar, at a location not coming in contact with fibre suspension to be screened and therefore not causing trouble should fibers gather on the welds.

Figure 3:
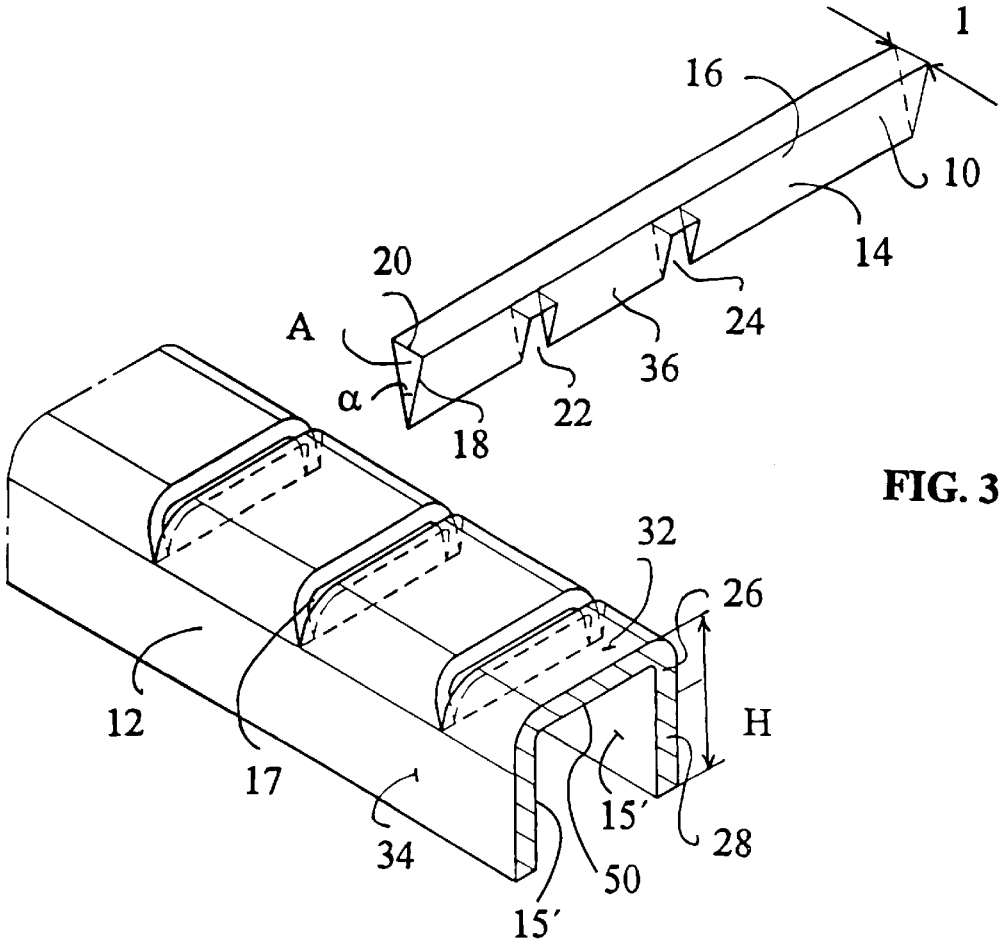
FIG. 3 shows schematically a top side view of a filter wire when being positioned onto a support element according to another embodiment of the present invention.
Figure 4:
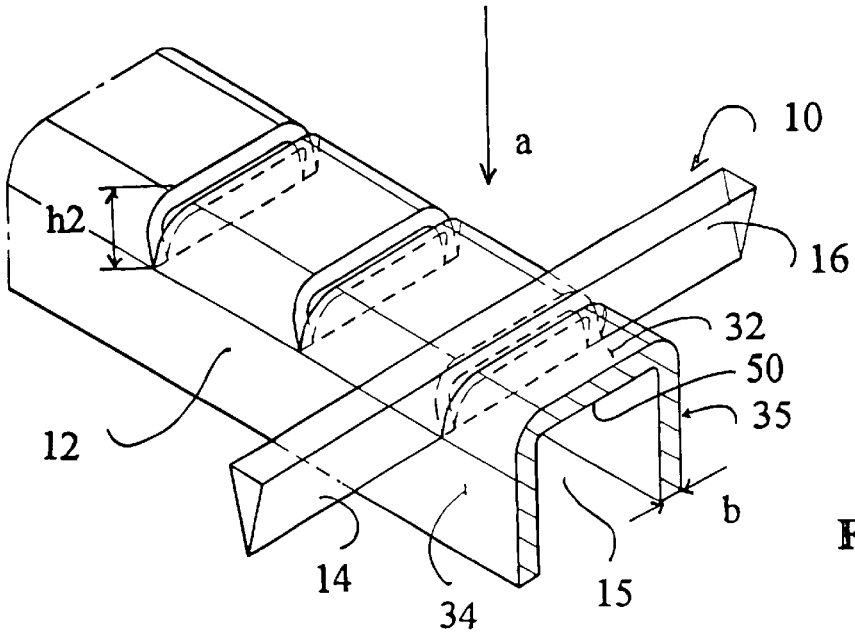
FIG. 4 shows the filter wire according to FIG. 3 positioned on the support element.

FIGS. 3 and 4 show schematically a top side view of a filter wire 10 and a support element 12, according to another embodiment of the present invention. FIG. 3 shows the filter wire 10, which has the form of a triangular bar, being positioned onto a support element 12, which in this embodiment is a U-bar. The filter wire 10 has a triangular cross section A, having two long sides 18 and a short side 20.

The filter wire 10 has an upstream portion 16 and a downstream portion 14. Two notches 22 and 24, at a distance of about 8.5 mm from each other, are machined in the downstream portion 14 or the downstream edge of the filter wire. The notches are here made before positioning the filter wire onto the U-bar. The notches could be made later when the filter wire is already positioned on the U-bar, if desired.

The U-bar has a first portion 26 or middle portion in which the bar is bent or angled, and a second supporting body portion 28. The support element is positioned in a screening device so that the first portion 26 faces the accept suspension flowing in the direction shown by arrow a (FIG. 2). A cavity 15 is formed within the U-bar, the cavity being open to the downstream side of the suspension passing the U-bar. The cavity is more or less in the blind of or covered from the suspension passing the external side of the U-bar. The cavity may, if desired, be covered e.g. by a filler, a metal strip or by a ring after joining the wire to the support bar. This also adds strength and stiffness of the construction.

A plurality of through openings, supporting slots 17, are cut through the middle portion 26, i.e. the middle surface 32 and a portion of the side surfaces 34 and 35, of the U-bar. The supporting slots are cut straight through the material to form through openings between the upstream side of the U-bar and the cavity 15. The supporting slots 17 formed have a triangular cross section of the same shape as the cross section of the filter wire 10 to be connected thereto, to adapt the supporting slot to receive the wire. It can be seen, in FIGS. 3 and 4, that the form of the cut in the side surface 34 of the U-bar is similar to the cross section of the downstream edge 14 of the filter wire.

FIG. 4 shows the filter wire 10 positioned in the supporting slot 17. The notches 22 and 24 (not shown) are located within the cavity 15 or the U-bar, the ends of the notches reaching almost to the inner side surface of the cavity.

As seen in each of FIGS. 1 through 4, the cavities 15 of the substantially U-shaped supporting elements 12 each have a substantially flat end surface 50, and substantially flat side surfaces 15' which are substantially perpendicular to the end surface 50. The wires 14 are deformed so that the base portions thereof (see 19 in FIG. 2 for the clearest illustration) are locally deformed into engagement with the substantially flat end surface 50. This enhances the secureness of the deformation, and allows the screening device, for example, in the form of a conventional screen cylinder mounted in a conventional pressure screen, to withstand the pluses and static pressures that it is subjected to, while maintaining the screening opening/slots tolerances at a level of plus or minus 0.3 mm or less.

Figure 5:
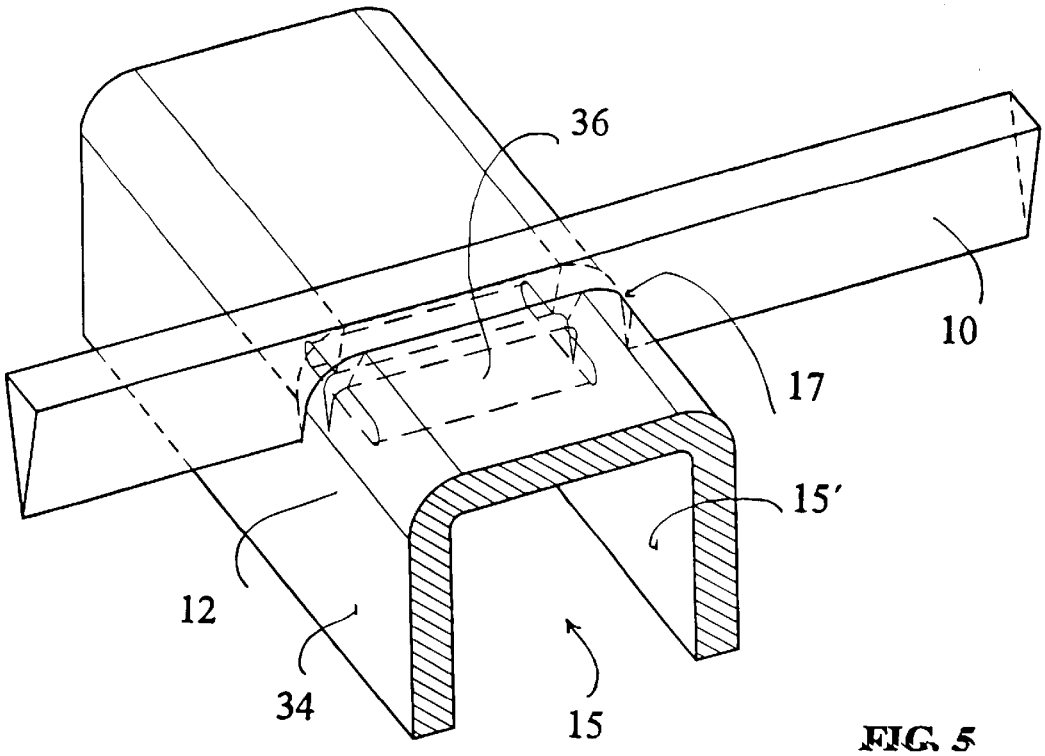
FIG. 5 shows the filter wire according to FIG. 3 fastened to the support element.
Figure 6:
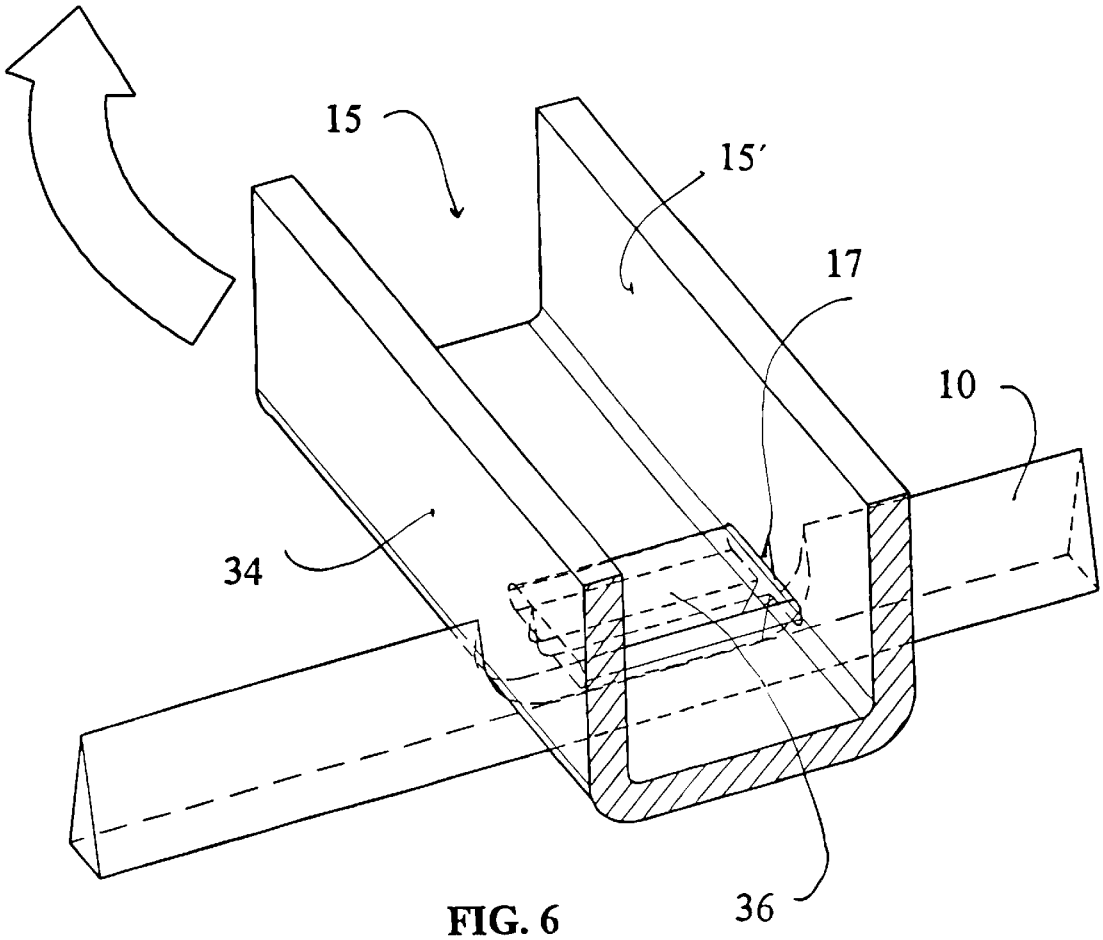
FIG. 6 shows the elements of FIG. 5 upside down.

FIG. 5 shows the filter wire 10 fastened or locked to the U-bar 12. A flap 36 (shown by broken line) formed in the filter wire edge between notches has been bent towards the innermost side surface 15' of the cavity in the U-bar, whereby the flap 36 locks the filter wire 10 at the U-bar, the flap 36 preventing the wire edge from being detached from the U-bar. FIG. 6 shows an upside-down view of the support bar and the filter wire connected thereto in FIG. 5. The flap 36 in the filter wire edge is seen protruding through a supporting slot 17 into the cavity in the U-bar and being bended against the inner surface of the U-bar.

Figure 7B:
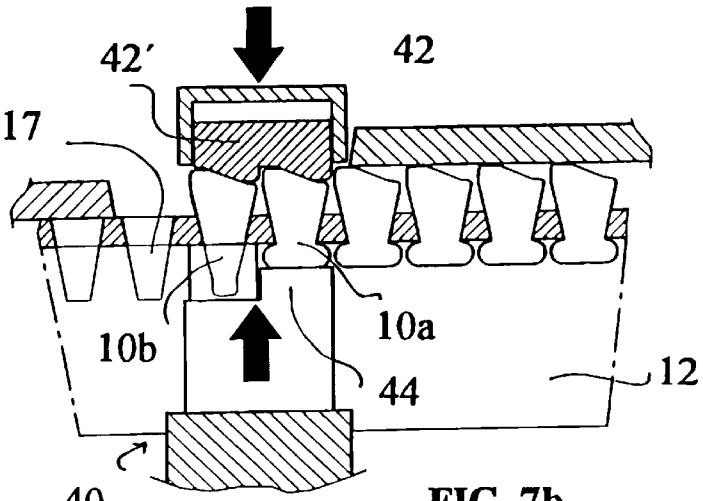
FIGS. 7*a* to 7*b* show schematically the assembly steps of filter wires being connected to a support bar in an assembly machine with tooling for deformation of base portions of the filter wires.
Figure 7D:
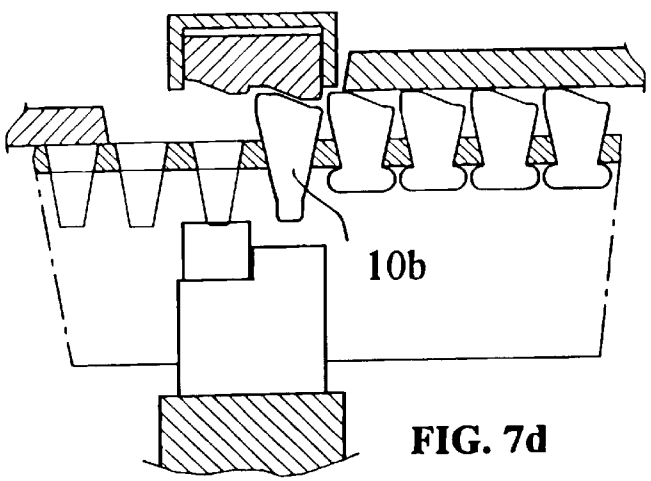
Figure 7A:
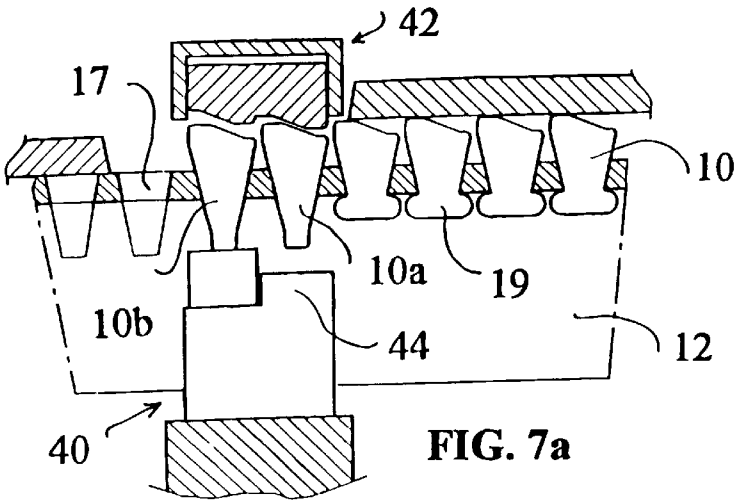

FIGS. 7*a* to 7*d* show fixing of filter wires into supporting slots in a support bar 12 by deformation of base portion 19 of filter wires 10. In FIG. 7*a* the support bar 12 is shown in section through its upper surface whilst positioned within an assembly machine with tooling 40, 42. The slots 17 in the upper surface of the support bar are clearly visible. Assembled and fixed filter wires 10 are shown on the right side or the exit side of the machine. The upper tool 42 has the facility to move vertically and is contoured or formed on the surface to match any corresponding contour or shape of the filter wires. The tool 40 incorporates the deformation tool profile 44, required to deform the base portion of the filter wire to produce the joint. In FIG. 7*a* a filter wire 10*a* is already inserted in a slot 17 and another filter wire 10*b* is shown being moved into position ready for fixing.

In FIG. 7*b* simultaneous movement of the upper tool 42 and the lower tool 40 creates a deformation force to upset the base portion 19 of the filter wire loa and creates a joint. Whilst the filter wire boa is being deformed the adjacent wire 10*b* is being clamped firmly in its slot 17 to prevent deformation of the slot or support bar under the loads of assembly.

The base portion of the filter wire 10*a* is deformed on the cavity side of the support bar 12, to increase the material thickness of the base portion of the wire section protruded into the cavity so that a deformed portion 46 is formed. The deformed portion is wider than the width of the supporting slot preventing the base portion of the wire to re-enter the slot and thereby locks the wire at the bar. The deformation may be made rather easily with the tool 44 pressing the thin edge of the wire, while simultaneously supporting the upper end 16 of the wire against e.g. an anvil 42'.

Figure 7C:
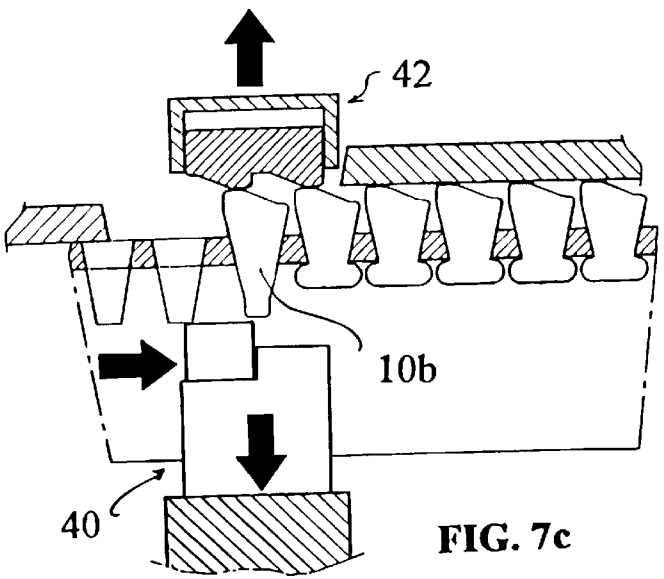

In FIG. 7*c* the upper tool 42 and lower tool 40 part and allow the upper support bar to index forward taking with it the already fixed filter wires and positioning the next filter wire 10*b* in the tooling ready for assembly. In view 7*d* the index of support bar is completed and the new filter wire 10*b* is in position ready for deformation. An empty slot is now available into which the next filter wire can be positioned.

The present invention provides several advantages over prior art screening devices and methods of manufacturing them. Screening devices having a strong construction may easily and cost-effectively be manufactured according to the present invention. The screening devices manufactured are able to withstand pulses and static pressure and simultaneously keep screening opening tolerances at an optimal level, preferably ±0.03 mm or less. The screening device according to the present invention does not have burrs or other elements, to which fibers are easily attached and accumulated. The present invention thereby provides a method for manufacturing screens with supporting slot widths between 0.1–0.5 mm, even <0.1 mm.

The scope of the present invention is not intended to be limited by the exemplary embodiments discussed above. The intention is to apply the invention broadly according to the scope of the invention as defined by the appended claims. It is e.g. not necessary to provide notches, as shown in FIGS. 3 to 6, in the filter wires, but FIGS. 1 to 2 embodiment may be preferred in most cases. The present invention may be utilized so as to first provide a plane filter plate of straight supports having filter wires connected thereto, which filter plate is thereafter formed into a cylinder or alternatively ring formed supports may be used, onto which filter wires are connected, so as to immediately form a cylindrical screen basket.

What is claimed is:

1. A screening device comprising:

a plurality of filter wires each comprising a first section and a second section opposite said first section, said second section having a base portion;

at least one longitudinal substantially U-shaped support bar having an upstream portion and a downstream portion defining first and second side surfaces, respectively, a plurality of slots in said first side surface, and a cavity machined in said second side surface in open communication with said slots, said cavity having a substantially flat end surface, and a pair of side surfaces, wherein a thickness of said side surfaces is less than a thickness of said upstream portion; and said second sections of said filter wires received by said slots so that said base portions extend through said slots into said cavity, and said wires are supported by said at least one support bar so that said wires are substantially parallel to each other and define screening openings therebetween adjacent said first sections thereof; and wherein said wires are fixed to said at least one support bar by local deformation of said base portions in said cavities into engagement with said substantially flat end surface.

2. A screening device as recited in claim 1 wherein said local deformation comprises an increased material thickness portion of said base portion formed by reciprocation of a tool.

3. A screening device as recited in claim 1; and wherein said second sections and base portions have a smaller cross-sectional area than said first sections.

4. A screening device as recited in claim 1 herein said first side surface is rounded; and wherein said second sections and base portions have a smaller cross-sectional area than said first sections.

5. A screening device as recited in claim 1 wherein said side surfaces are substantially flat and substantially perpendicular to said end surface.

6. A screening device as recited in claim 1 wherein said support bar has a material thickness of about 1–5 mm.

7. A method of manufacturing a screening device comprising:

(a) providing a plurality of filter wires each having opposite first and second sections, and a base portion at the second section; and at least one longitudinal substantially U-shaped support bar having an upstream portion and a downstream portion defining first and second side surfaces, respectively, a plurality of slots in the first side surface, and a cavity machined in the second side surface in open communication with the slots, said cavity having a substantially flat end surface, and a pair of side surfaces, wherein a thickness of said side surfaces is less than a thickness of said upstream portion;

(b) inserting the wires in the slots so that the base portions thereof extend into the cavity and the wires are substantially parallel to each other and define screening openings between the first sections thereof; and (c) fixing the wires to the at least one support bar substantially within the cavity by locally deforming the base portions of the wires into engagement with the substantially flat end surface.

8. A method as recited in claim 7 wherein (c) is practiced by reciprocating a tool into contact with the base portions to effect mechanical deformation thereof.

* * * * *